United States Patent [19]

Evans

[11] 4,107,487

[45] Aug. 15, 1978

[54] INTERRUPTER SWITCH ARRANGEMENT

[75] Inventor: David M. Evans, Palatine, Ill.

[73] Assignee: S & C Electric Company, Chicago, Ill.

[21] Appl. No.: 775,905

[22] Filed: Mar. 9, 1977

[51] Int. Cl.[2] ..... H01H 33/44

[52] U.S. Cl. ..... 200/48 KB; 74/521

[58] Field of Search ..... 200/48 R, 48 KB, 48 A, 200/48 V; 74/521

[56] References Cited

U.S. PATENT DOCUMENTS

| | | | |
|---|---|---|---|
| 1,394,968 | 10/1921 | Christensen | 200/48 R |
| 1,903,095 | 3/1933 | Desmond | 200/48 R |
| 1,995,126 | 3/1935 | Knowles | 200/48 R |
| 3,780,625 | 12/1973 | Weston | 200/48 R |

*Primary Examiner*—Robert W. Jenkins

*Attorney, Agent, or Firm*—Kirkland & Ellis

[57] ABSTRACT

Disclosed is a switch suitable for use in power systems. The switch is of the vertical break type, having two stationary support insulators and one reciprocatory, insulative push rod, wherein movement of a switch blade takes place in a plane which also includes the insulators and the push rod. The two insulators are mounted on a base, one insulator supporting a switch blade hinge assembly, and the other insulator supporting a contact assembly for the switch blade. A novel linkage mounted to the hinge assembly connects the blade to the push rod and permits at least 90° of movement of the blade without adversely affecting dielectric clearances between the push rod and the insulators. The insulators remain stationary when the switch operates, only the push rod and the novel linkage moving to provide motive force to the blade. The push rod may be reciprocated by interconnection to a rotatable shaft via a lever. The shaft may be connected to an operating pipe reciprocated by a remote operator to rotation therewith. After the switch is open, the novel linkage permits the push rod and the lever to form an over-center toggle which, together with the more than 90° opening of the blade, prevents the blade from inadvertently moving toward engagement with the stationary contact as a result of external forces such as wind, etc. The switch and the linkage are usable in single pole and polyphase switches in a variety of configurations.

17 Claims, 3 Drawing Figures

INTERRUPTER SWITCH ARRANGEMENT

BACKGROUND OF THE INVENTION

1. Field of the Invention

The present invention relates to an improved electrical switch and a linkage therefor. More particularly, the present invention relates to a high voltage switch of the vertical break type and to a linkage therefor.

2. Description of the Prior Art

High voltage switches having a pivotable switch blade and a stationary contact selectively engageable by the blade are often categorized as either disconnect switches or interrupter switches. A disconnect switch is one designed to isolate a line or to open a circuit where neither the line nor the circuit are energized at the time of switch operation. An interrupter switch may take the same form as a disconnect switch, but has the additional provision of a device called an interrupting unit, which permits operation of the switch while the line or circuit is energized. The interrupting unit provides a parallel path for electric current which is selectively directed thereto during switch blade movement. Thus, no external arcing occurs between the switch blade and the stationary contact when they are disengaged. Rather, the arc is permitted to form internally within the interrupting unit where it is interrupted or extinguished. See commonly-assigned U.S. Pat. No. 3,909,570 issued to Harner et al. for a description of one type of interrupting unit, and also commonly-assigned U.S. Patent application Ser. No. 775,904 filed on the same date herewith, for an interrupting unit designed for use at voltages of up to 34.5 kV.

It is well known in the art that various metallic parts of high voltage switches of either category must be maintained predetermined distances apart both in their open and closed positions. This separation is necessitated by the presence of high voltage and prevents undesired arcing between the separated parts. It is generally accepted that vertical-break or vertical-opening switches permit minimum spacing between the poles of polyphase high voltage switches while achieving the necessary separation.

Generally speaking, a vertical-break switch is one where the switch blade is hinged to a first insulator to move into and out of engagement with the stationary contact mounted on a seconc insulator. Movement of the blade is included in a plane which also includes the insulators. In the most desirable form of vertical-break switch, such blade movement is effected by an insulative push rod connected between the blade and an operating mechanism thus permitting the minimum number of insulators per pole. However, until the present invention, such vertical-break switches have been confined to use in indoor, or metal-enclosed switchgear, primarily because maximum switch blade movement away from the stationary contact has been limited to about 70°. This limitation is established by interference between the push rod and other portions of the switch where more than 70° opening has been attempted. Thus, the use of vertical-break switches operated by a push rod in outdoor environments has been virtually non-existent. This is because, among other reasons, outdoor switches require at least 90° opening so that a human operator may visually determine, by observing the presence of a 90° air gap between the blade and the stationary contact, that the switch is indeed open.

Outdoor switches of the so-called side-break variety are also well-known. They are usable at high voltages, such as 34.5 kV, but require more room overall than vertical-break switches, because adequate spacing must be maintained between the parts of the rspective switch poles both in the switch-open and switch-closed positions. Moreover, side-break switches, although having only two insulators, generally move the switch blade away from their stationary contacts by rotation of an insulator connected thereto through the required angle. This construction requires a mechanically strong rotating insulator bearing assembly.

Vertical-break switches providing 90° are also known, but these usually include complicated conversion of rotary motion to pivotal blade motion, as well as a third insulator to support the motion-converting, blade-moving mechanism.

At times a triangular configuration for a switch is preferred because of the triangular configuration of the conductors connected to the switch. The art has not had a simple, economical vertical-break switch for such conductor configurations at high voltages. Rotary, side-break types of triangular switches are known, but they suffer from the same shortcomings as do all side-break switches. Similarly, 90° opening, triangular switches of the three insulator variety, with the shortcomings thereof, are known.

Accordingly, one object of the present invention is to provide an improved electrical switch and linkage therefor which obviate the shortcomings of the prior art, above-described.

Another object of this invention is the provision of a high voltage switch of the vertical-break type and of a linkage therefor which makes such a switch compact, practical and simple, requiring a minimum number of insulators.

Yet another object of the present invention is the provision of a vertical-break type of switch, usable with or without an interrupting unit, and usable at high voltages such as 34.5 kV, wherein the blade of the switch is pivoted by a push rod, which switch includes a novel linkage permitting the attainment of this objective.

A still further object of the present invention is to provide a vertical-break switch, as described immediately above, wherein the switch blade moves to its open position from its closed position through an angle of at least 90°, and wherein the push rod and a drive mechanism therefor form an over-center toggle in the open position, both of these objectives being attained through the use in the switch of the novel linkage of the present invention. These objectives being attained, inadvertent closing of the switch due to wind or the like is prevented.

Yet another object of the present invention is the provision of a vertical-break switch and novel linkage as described immediately above, wherein, during operation of the switch, dielectric clearances of the various parts of the switch are not adversely affected.

BRIEF SUMMARY OF THE INVENTION

The present invention contemplates an electrical switch and a novel linkage therefor. The switch is of the vertical-break variety wherein a switch blade is pivotally mounted to a first insulator for movement into and out of engagement with a contact mounted to a second insulator. Blade movement is included in a plane which also includes the insulators, and preferably, includes both the contact and the pivot point of the blade. Blade movement is effected by a push rod pivotally connected to the blade which in turn is reciprocated by reciprocation of an operating pipe through operation of a remote operator. The push rod and the pipe are interconnected by appropriate instrumentalities for translating reciprocation of the pipe into reciprocation of the push rod. The blade and the push rod are interconnected by the novel linkage of the present invention.

The linkage includes a first link pivotally connected to the blade, preferably near the blade's pivot point and also pivotally connected to a proximate portion of the push rod. A second link of the linkage is commonly, pivotally connected to a proximate portion of the push rod, preferably in common with the first link, and is pivotally connected to a fixed point, preferably near the hinge pivot on the first insulator. The use of the linkage permits push rod movement of the blade through an angle of more than 90° and also facilitates the formation of an over-center toggle by a distal portion of the push rod and the interconnecting instrumentalities to prevent inadvertent operation of the switch.

With the above OBJECTS and SUMMARY in view, these and other objects, advantages and features shall appear hereinafter. For the purposes of illustration, but not for limitation, an exemplary embodiment of the present invention is illustrated in the accompanying DRAWINGS and DETAILED DESCRIPTION.

DETAILED DESCRIPTION

The switch of the present invention, and the novel linkage used therein, are described herein with reference to a switch, more completely described in commonly-assigned U.S. application Ser. No. 775,903, filed on the same date herewith in the names of Joseph Bernatt and Karel Vojta. That switch is described as including an interrupting unit, more completely described in commonly-assigned application, Ser. No. 775,904, filed on the same date herewith in the names of David M. Evans and Joel A. Ramos. It is understood that the present invention, including the novel switch and the novel linkage therein, is intended to include, and to be usable in, any switch, including those generally classifiable as a vertical-break switch. Moreover, the switch and the linkage of the present invention, may be embodied in a disconnect switch or in an interrupter switch, either being usable at any voltage.

Figure 1:
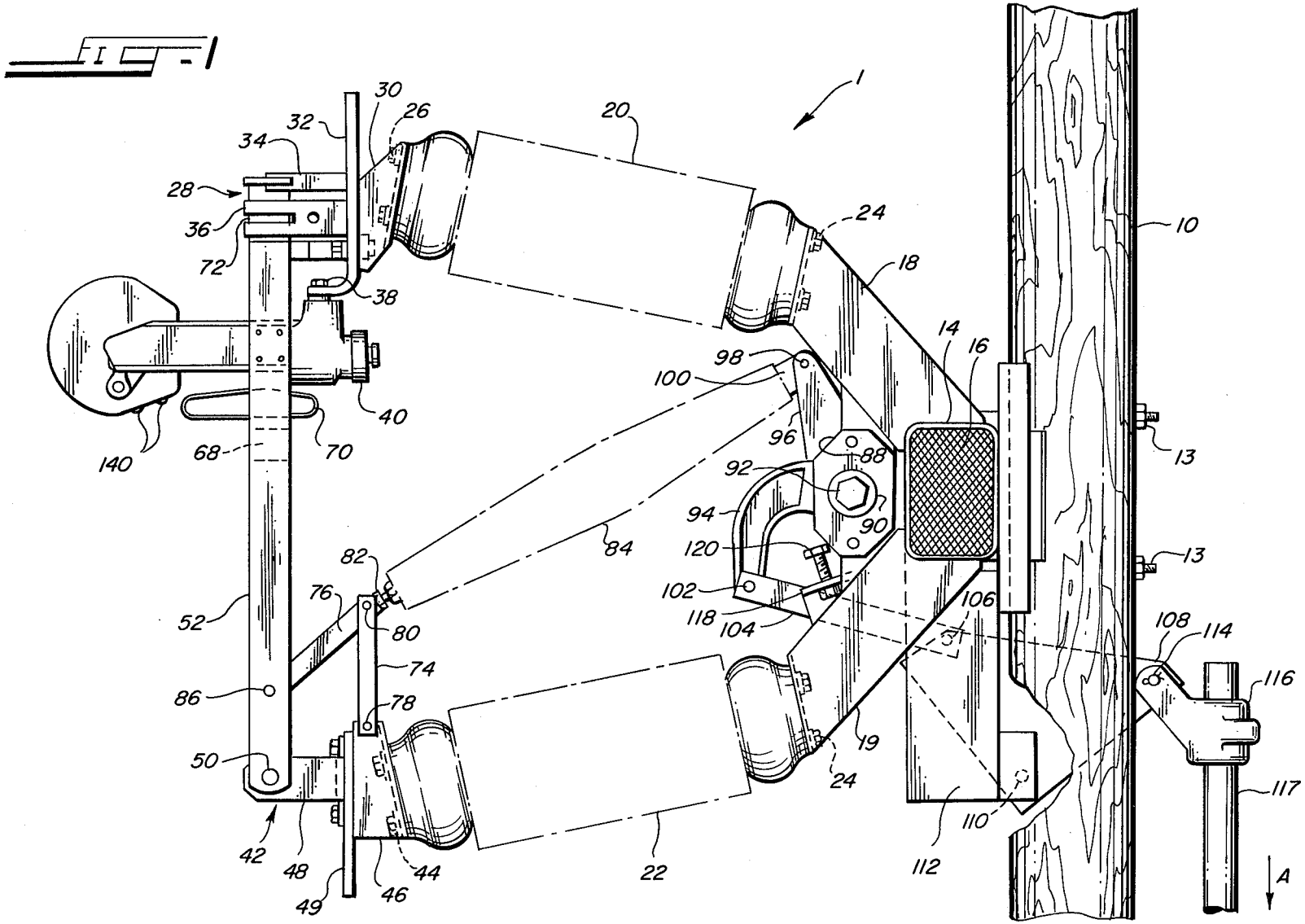
FIG. 1 is a side, partially fragmentary view of a switch embodying the principles of the present invention.
Figure 3:
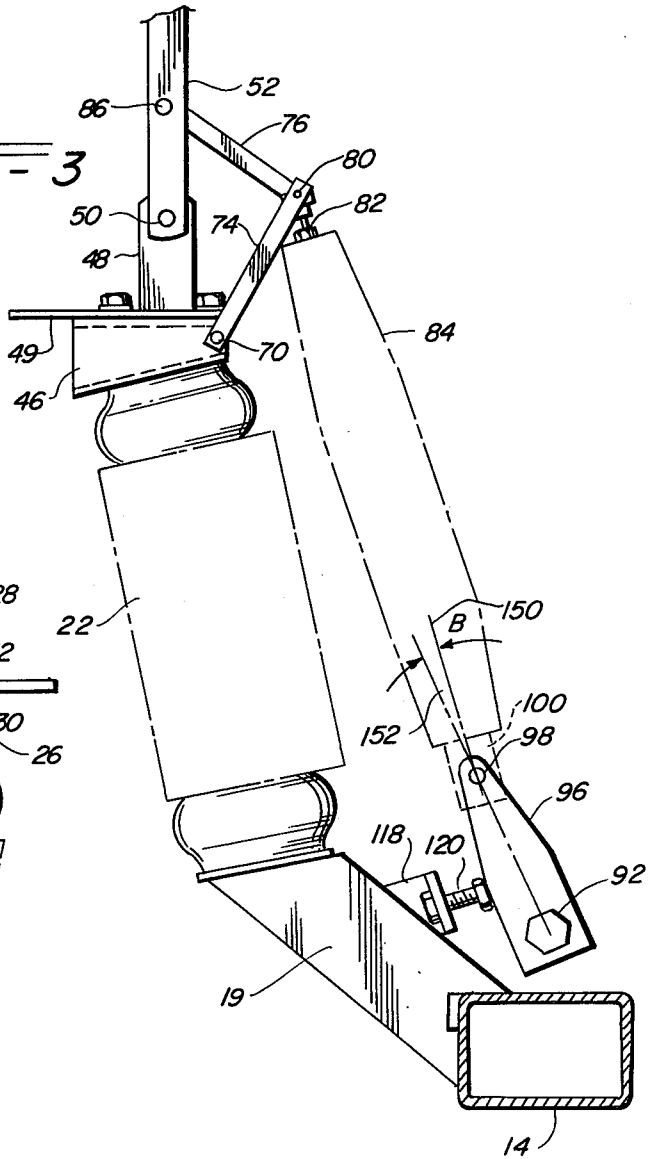
FIG. 3 is a side, elevational view similar to FIG. 2, but showing the switch and the linkage of the present invention with the switch in the opened position.
Figure 2:
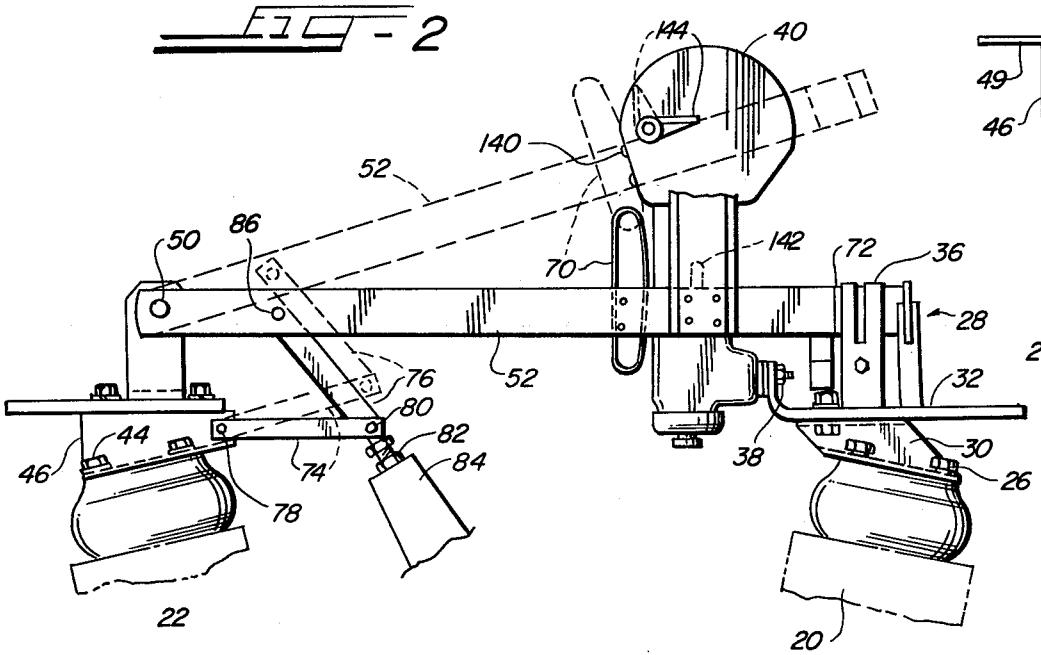
FIG. 2 is side, partially fragmentary, view of the portion of the switch in FIG. 1 illustrating in more detail the principles of the present invention, and showing both the novel switch and the novel linkage thereof as embodied in this invention, with the switch fully closed and at the beginning of an opening operation thereof.

FIGS. 1-3 hereof are similar to FIGS. 2, 7 and 8, respectively of the aforementioned commonly-assigned application, Ser. No. 775,903.

Referring to the FIGURES, a single phase or pole of an interrupting switch 1 utilizing the present invention is shown mounted to a supporting structure, such as a utility pole 10. The present invention is applicable to single phase switches or to polyphase switches of a wide variety of configurations having a plurality of poles. Moreover, the switch 1 may be a disconnect switch as well as an interrupting switch.

The switch 1 includes a mounting block or gaining channel 12 that can be suitably mounted to the utility pole 10, as by bolts 13. Carried by the block 12 is a hollow structural member or base 14, which may have mesh 16 fixed to the ends thereof to prevent the entry of birds and insects. First and second arms 18 and 19 are mounted to the member 14. Respectively mounted on the arms 18 and 19 by bolts 24 or other convenient facilities are first and second stationary insulators 20 and 22. Mounted to the free end of the first insulator 20 by bolts 26 or other means is a contact assembly 28, which includes an adapter bracket 30, a terminal pad or backup plate 32, striking contact fingers 34 and one or more stationary electrical contacts 36. Also mounted to the terminal pad 32 by bolts 38 or other connectors is an interrupting unit 40. The interrupting unit may conveniently take the form of that disclosed in U.S. Pat. No. 3,909,570, or in commonly-assigned, co-pending application, Ser. No. 775,904, filed on the same date herewith.

Mounted to the free end of the second insulator 22 by bolts 44 or other convenient means is a switch blade assembly 42, which includes a hinge adapter bracket 46, a terminal pad 49, a hinge assembly 48, and a switch blade 52 pivotally mounted on the free end of the hinge assembly 48 by a shaft 50. The switch blade 52 may have plural arms (not shown) which straddle the hinge assembly 48.

A spring contact 70 is mounted to the switch blade 52 in a position to engage contact buttons 140 on the interrupting unit 40 during movement of the blade 52, for a purpose more fully described hereinafter. The end of the blade 52 may be so shaped as to form a blade contact 72 which is engageable with the stationary contact 36.

Also included is a novel linkage 73 of the present invention, described more fully below. The linkage 73 comprises links 74 and 76. The link 74 is pivotally mounted at one end by a pin 78 to the hinge adapter bracket 46 near the shaft 50. The other end of the link 74 is pivotally mounted by a pin 80 to one end of the link 76 and to a clevis 82 mounted on a proximate end of an insulative push rod 84. The other end of the link 76 is pivotally mounted to the switch blade 52 by a pin 86 near the shaft 50.

Extending between the arms 18 and 19 is a bearing bracket 88 through which are mounted bearings 90. The bearings 90 rotatably support a drive shaft 92 which extends a sufficient length of the member 14 to accommodate as many switch poles as are mounted thereon. A curved drive lever 94 is locked on the drive shaft 92 in a manner to effect rotation thereof when the lever 94 is rotated. Also affixed to the shaft 92 adjacent the push rod 84 is a lever 96. When the shaft 92 is rotated, the lever 96 is also rotated. As many levers 96 are on the shaft 92 as there are switch poles on the member 14. The lever 96 is pivotally connected by a pin 98 to a clevis 100 mounted on the distal end of the push rod 84.

Pivotally mounted by a pin 102 to the curved end of the drive lever 94 is a drive-connecting link 104. The other end of the drive-connecting link 104 is pivotally connected by a pin 106 to a bell crank member 108. The bell crank member 108 may take any convenient configuration such as the triangular shape shown. The pin 106 is located at or near one apex of the triangular bell crank member 108. At another apex a pin 110 pivotally mounts the bell crank member 108 to a support 112 mounted on the member 14. Pivotally mounted at a third apex of the bell crank member 108 by a pin 114 is a pipe connector 116 which is attached to the end of a reciprocable operating pipe 117, in turn connected to a remote switch operator (not shown). Mountd on the arm 19 is a stop bracket 118, an adjustable stop 120 being in turn mounted thereon in a position to be engageable by the lever 96.

Again, it should be understood that the switch 1 may have any desired number of poles, on one or more members 14 mounted in any convenient configuration, as shown, for example, by the various embodiments of FIGS. 1, 5, 6, and 9-11 of co-pending application, Ser. No. 775,903, referred to earlier. Also, the interconnection between the pipe 117 and the shaft 90 may take any convenient form.

The operation of the single pole of the switch 1 will now be described. In the usual installation, the switch 1 will contain one pole or phase respectively connected to each phase of a polyphase electric circuit. One side of each phase of the circuit is connected to its corresponding terminal pad 32, and the other side of that phase of the circuit is connected to the corresponding terminal pad 49, so that in the switch-closed position the electric circuit of each phase is completed through its corresponding switch blade 52 engaged with the stationary contact 36. When it is desired to open the switch and render the circuit discontinuous, the operating pipe 117 is moved downwardly in the direction of arrow A, pivoting the bell crank 108 about the pin 110, which in turn moves the drive link 104 to pivot the drive lever 94 so that the shaft 92 is rotated. Rotation of the shaft 92 pivots the lever 96 to reciprocate the push rod 84 toward the pinned junction of the links 74 and 76.

With specific reference to FIG. 2, as the push rod 84 is so reciprocated, the links 74 and 76 pivot the switch blade 52 about the shaft 50 until the blade contact 72 disengages from the stationary electrical contact 36 as shown in dotted lines. As the switch blade 52 is pivoted, the spring contact 70 engages the contact buttons 140 on the interrupting unit 40 completing a parallel electrical circuit through the interrupting unit 40 to the terminal pad 32 before the blade contact 72 disengages the stationary contact 36. Thus, there is a parallel current path through the interrupting unit 40 at the time the switch blade 52 disengages the contact 36, so that no external electrical arc is formed at the contact assembly 28.

With continued reference to FIG. 2 and further reference to FIG. 3, it can be seen that the major axis of the push rod 84 is effectively in line with the link 76 during the entire time of motion of the blade 52, so that substantially all of the thrust of the push rod 84 is applied to the switch blade 52 through the pin 86. Near the closed position of the switch 1 (FIG. 1 and solid portion of FIG. 2), the link 74 is relatively unloaded and serves to guide the junction of the push rod 84 and the link 76. It is when the switch blade 52 is in the zone between fully closed and the position shown in dashed lines in FIG. 2 that a direct-drive relationship between the blade 52 and the lever 96 through the push rod 84 is most advantageous in overcoming inertia and friction and results in high velocity of the blade 52. As the blade 52 approaches the fully-opened position, as shown in FIG. 3, the effective radius of the pin 80 about the shaft 50 is reduced, so that increased rotation of the blade 52 with respect to movement of the push rod 84 is effected. Thus, opening of the blade 52 in excess of 90° from the closed position is readily obtained,. This amount of angular travel (i.e., more than 90°) is recognized to be an important and conventional, if not a necessary, feature of a vertical-break type of high voltage switch, in that inadvertent movement of the blade 52 toward the contact 36 cannot occur.

It can also be seen in FIG. 3 that if the linkage 73, including the links 74 and 76, were not provided, and the push rod 84 was directly connected to the blade 52 at an efficient location, the push rod 84 would collide with the insulator 22 in the blade-open position where the blade 52 moves 90° or more. Clearance between the insulators 20 and 22 and the push rod 84 is required in all positions of the blade 52 for dielectric reasons and to provide space for ice build-up in freezing weather, as is well known in the art.

Referring again to FIG. 1, it is seen that the push rod 84 is clear of both insulators 20 and 22 when the switch 1 is closed. It is also seen that in this position the orientation of the lever 96 has been chosen to establish the previously described in-line relationship of the push rod 84 and the link 76. Moreover, in the open position of FIG. 3, the push rod 84 and the lever 96 attain an over-center toggle relationship which locks the blade 52 open. Specifically, the centerline 150 of the push rod 84, defined by its points of pivotal connection at the pins 80 and 98, includes an angle B with the center line 152 of the lever 96, defined by its points of connection at the pin 98 and at the shaft 92. Because of both the more than 90° opening of the blade 52 and the over-center toggle, the blade 52, once opened, cannot move toward the contact 36, absent intentional rotation of the shaft 92. In the preferred embodiment depicted in FIGS. 1-3, the length, orientation and points of pivotal connection of the links 74 and 76 are all chosen so that, with reference to the same characteristics of the push rod 84 and the lever 96, in the closed position the link 74 is substantially parallel to the blade 52, and the link 76 is in line with the push rod 84, as previously described. In the switch-open position, although the link 76 deviates somewhat from this in-line position, it remains substantially in line and so oriented to the center line 152 of the push rod 84 as to receive the majority of the motive force therefrom. Additionally, the push rod 84 during its reciprocation also moves toward and away from the insulators 20 and 22, but remains substantially parallel to and spaced from the insulator 22 during such reciprocation and movement. Moreover, the pin 80, in the switch-open position, occupies a position quite near the position occupied by pin 86 in the switch-closed position. Clearly, other lengths, orientations and points of connection for the involved parts may be chosen to achieve the results of the present invention without departing from the scope thereof.

For purposes of the present description it need only be understood that the interrupting unit 40 provides a parallel electrical path to the blade 52 via the spring contact 70 and the buttons 140. This parallel path exists until such time as a cam 142 mounted on the blade 52 engages and pivots a trigger 144 (shown in dotted lines) on the far side of the interrupting unit 40 to the position shown. When the trigger 144 is so pivoted, the internal mechanism of the interrupting unit 40 interrupts the circuit and the resulting arc at a time when the blade contact 72 is sufficiently distant from the contact 36 so that an electrical arc does not form between them.

Thus, external arcing between the contact 36 and the switch blade 52 is avoided when current is interrupted.

The shaft 92 rotates until the lever 96 engages the adjustable stop 120 (see FIG. 3). In this position, the center line 150 of the push rod 84 forms the slight angle B with respect to the center line 152 of the lever 96. Thus, the lever 96 and the push rod 84 are at the over-center toggle position as previously described. Wind or other external forces applied to the switch blade 52 cannot pivot the switch blade 52 back into engagement with contacts 36.

When it is desired to close the switch 1, the rod 117 is moved in the opposite direction of the arrow A so that the shaft 92 is rotated in the opposite direction causing the push rod 84 to pull against the links 74 and 76 pivoting the switch blade 52 back into the position illustrated in FIGS. 1 and 2. As the switch blade 52 is pivoted back, another cam (not shown) on the blade 52 engages a trigger 145 on the near side of the interrupting unit 40 closing the internal contacts thereof (not shown) so that the interrupting unit 40 is ready for the next switch-opening operation.

Because of the efficient pull of the push rod 84 on the blade 52 via the linkage 73 due to the alignment of the push rod axis 150 with the link 76, high velocity movement of the blade toward the contact 36 is easily attained. Such high velocity movement permits the switch 1 to be rated for fault closing. Moreover, both high velocity opening and closing of the switch 1 result in efficient operation of the interrupting unit 40 to positively interrupt arcs therewithin, as described above.

It should be apparent that in applications where a current interrupting function is not required, omission of the interrupter unit 40 from the switch 1 will provide a polyphase, vertical break disconnect switch within the scope of this invention.

I claim:

1. In an electrical switch of the type which includes a first insulator having a contact thereon; a switch blade pivotally mounted to a second insulator for movement into and out of engagement with the contact in a plane including the insulators; and a reciprocable push rod for pivoting the switch blade upon movement of a distal portion of the push rod, an axis of the push rod through the distal portion being included in the plane; an improved linkage means for connecting the push rod to the switch blade, comprising:

a first link having a first pivotal connection to the switch blade near the pivotal blade mount, and a second pivotal connection to a proximate portion of the push rod included by the axis; and a second link having a first pivotal connection to a fixed point near the pivotal blade mount and a second pivotal connection to the proximate push rod portion, all force applied to and exerted by the push rod along the axis thereof due to movement of its distal portion being applied to, and along, a line defined by the pivotal connections of the first link during the movement of the switch blade.

2. The linkage of claim 1 wherein the switch blade is movable thereby at least approximately 90° away from its engagement with the contact.

3. The linkage of claim 2, wherein, when the switch blade engages the contact, the line defined by the pivotal connections of the first link is generally coextensive with the push rod axis; and a line defined by the pivotal connections of the second link is generally parallel to the switch blade.

4. The linkage of claim 3, wherein the pivotal connections of the first and second links to the proximate push rod portion are common, and wherein, when the switch blade is approximately 90° away from its engagement with the contact, the common first and second link pivotal connections occupy substantially the same position as occupied by the pivotal connection of the first link to the switch blade when the switch blade engages the contact.

5. An improved electrical switch of the type including a first insulator having a contact thereon; a switch blade pivotally mounted to a second insulator for at least approximately 90° movement into and out of engagement with the contact in a plane including the insulators; a reciprocable push rod included in the plane for pivoting the switch blade upon its reciprocation; and a lever pivotally connected to a distal portion of the push rod and mounted to a rotatable shaft for reciprocating the push rod in response to shaft rotation, wherein the improvement comprises:

(a) a first link having a first pivotal connection to the switch blade near the pivotal blade mount, and a second pivotal connection to a proximate portion of the push rod; and (b) a second link having a first pivotal connection to a fixed point near the pivotal blade mount, and a second pivotal connection to the proximate push rod portion, substantially all of the reciprocatory force applied to the push rod by the lever being applied to, and substantially along, a line defined by the pivotal connections of the first link during the at least 90° blade movement.

6. The switch of claim 5 wherein an axis of the push rod defined by a line including the pivotal push rod connections is substantially parallel to the second insulator during the at least 90° blade movement.

7. The switch of claim 6 wherein after the at least 90° movement of the blade away from the contact, the push rod and the lever form an over-center toggle which prevents movement of the blade toward the contact absent rotation of the shaft.

8. The switch of claim 7 wherein, when the switch blade engages the contact, a line defined by the pivotal connections of the first link is generally parallel to the push rod, and a line defined by the pivotal connections of the second link is generally parallel to the switch blade.

9. The switch of claim 8 wherein the pivotal connections of the first and second links to the proximate push rod portion are common, and, when the switch blade is at least 90° away from its engagement with the contact, occupy substantially the same position as the pivotal connection of the first link to the switch blade occupies when the switch blade engages the contact.

10. Apparatus for translating rotary shaft motion to pivoting motion of a member about a pivot point to which the member is connected, comprising:

a lever mounted to the shaft for rotation therewith;

a push rod having a pivotal connection to the lever for generally reciprocatory movement upon rotation of the lever;

a first link having both a pivotal connection to the push rod remote from the push rod-lever connection and a pivotal connection to the member; and a second link having both a pivotal connection to the push rod remote from the push rod-lever connection and a pivotal connection to a fixed point, substantially all of the reciprocatory force applied to the push rod by the lever being applied to, and substantially along, a line defined by the pivotal connections of the first link during pivoting motion of the member.

11. The apparatus of claim 10 wherein the member is a blade of an electrical switch.

12. In a switch of the type including two insulators mounted to and extending from a base; a stationary contact mounted on one insulator; a switch blade pivotally mounted to the second insulator, the blade engaging the stationary contact when the switch is in the closed position; and an insulative push rod; an improved linkage means for moving the blade by a switch operator connected to the push rod to effect switch blade movement through an arc of over 90° to open the switch, the linkage means comprising:

a first link pivotally connected at one end to the push rod and pivotally connected at its other end to the second insulator; and a second link pivotally connected at one end to the push rod in common with the connection of the first link thereto and pivotally connected at its other end to the switch blade, the line defined by the points of connection of the second link remaining substantially coextensive with the line defined by the points of connection of the push rod during the over 90° movement arc of the blade.

13. The linkage of claim 1 wherein the blade movement is included in a plane which also includes the insulators and the points of connection of the push rod.

14. The linkage of claim 13 wherein both the connection of the other first link end to the second insulator and of the other second link end to the switch blade are near the pivotal mounting of the blade to the second insulator.

15. The linkage of claim 14 wherein, when the switch is closed, the points of connection of the first link define a line substantially parallel to the switch blade.

16. In an electrical switch of the type which includes a first insulator having a contact thereon; a blade pivotally mounted to a second insulator for movement into and out of engagement with the contact in a plane including the insulators; and a reciprocable push rod included in the plane for pivoting the blade upon reciprocation; an improved linkage means for connecting the push rod to the blade, comprising:

a first link having a first pivotal connection to the blade and a second pivotal connection to the push rod; and a second link having a first pivotal connection to a fixed point and a second pivotal connection to the push rod, a line defined by the pivotal connections of the first link remaining substantially in line with the push rod during pivoting of the blade.

17. The linkage of claim 16 wherein the second pivotal connections of both links are substantially common; and the first pivotal connections of both links are near the pivot point of the blade.

* * * * *

UNITED STATES PATENT AND TRADEMARK OFFICE

CERTIFICATE OF CORRECTION

PATENT NO. : 4,107,487

DATED : August 15, 1978

INVENTOR(S) : David M. Evans

It is certified that error appears in the above-identified patent and that said Letters Patent are hereby corrected as shown below:

IN THE ABSTRACT:

Column 2, line 15, "to" should read "for".

Column 2, line 13, after "90" insert "opening".

Column 10, line 1, "claim 1" should read "claim 12".

Signed and Sealed this

*Tenth* Day of *June 1980*

[SEAL]

*Attest:*

SIDNEY A. DIAMOND

*Attesting Officer*

*Commissioner of Patents and Trademarks*